US007966747B2

(12) United States Patent
Wilkenfeld et al.

(10) Patent No.: US 7,966,747 B2
(45) Date of Patent: Jun. 28, 2011

(54) DANCE FOOTWEAR

(75) Inventors: David Wilkenfeld, Sydney (AU); Felicia Leoncelli, Sydney (AU)

(73) Assignee: Pointe Noir Pty Ltd. (AU)

( * ) Notice: Subject to any disclaimer, the term of this patent is extended or adjusted under 35 U.S.C. 154(b) by 921 days.

(21) Appl. No.: 11/576,879

(22) PCT Filed: Sep. 29, 2005

(86) PCT No.: PCT/AU2005/001504

§ 371 (c)(1),
(2), (4) Date: Oct. 19, 2007

(87) PCT Pub. No.: WO2006/037154

PCT Pub. Date: Apr. 13, 2006

(65) Prior Publication Data

US 2008/0034613 A1 Feb. 14, 2008

Related U.S. Application Data

(63) Continuation of application No. 29/239,169, filed on Sep. 26, 2005, now Pat. No. Des. 538,515.

(60) Provisional application No. 60/617,612, filed on Oct. 8, 2004.

(51) Int. Cl.
*A43B 5/12* (2006.01)

(52) U.S. Cl. ..... 36/8.3; 36/102; 36/11.5

(58) Field of Classification Search ..... 36/11.5, 36/8.3, 102, 97, 4, 51

See application file for complete search history.

(56) References Cited

U.S. PATENT DOCUMENTS

| | | | | |
|---|---|---|---|---|
| 726,778 | A | 4/1903 | Smith | |
| 900,881 | A | 10/1908 | Parker | |
| 1,754,054 | A | 4/1930 | Selva | |
| 1,872,641 | A | 8/1932 | Capezio | |
| 1,930,188 | A | 10/1933 | Arthur | |
| 1,953,659 | A | 4/1934 | Savino | |
| 2,237,652 | A | 4/1941 | S. Capezio | |
| 2,252,315 | A * | 8/1941 | Doree | 36/9 R |
| 2,332,252 | A | 10/1943 | Payne | |

(Continued)

FOREIGN PATENT DOCUMENTS

| | | |
|---|---|---|
| CA | 1077711 | 5/1980 |

(Continued)

OTHER PUBLICATIONS

Capezio, dancesport, dancewear, bodywear, dance sneakers, capezio shoes; 1 page—Footundeez, H07. http:/www.capeziodance.com/page.jsp?s=6&p=1462; printed Jun. 27, 2005, believed to have been published prior to the earliest effective filing date for this application.

(Continued)

*Primary Examiner* — Marie Patterson
(74) *Attorney, Agent, or Firm* — Ganz Law, PC

(57) ABSTRACT

An item of footwear (10), which exposes a substantial portion of a wearer's foot, is disclosed. The footwear includes a plurality of foot enclosures (110, 112) operably connected to each other via a connector (114), such as a plurality of elastic straps (200, 202). Protective pads (180, 182) may be attached to the footwear, such as leather pads on the plantar surface of the footwear. One advantage offered by this footwear is that the wearer's foot—and particularly the arch and middle of the foot—is substantially exposed to view, achieving a new aesthetic for ballet and dance footwear.

32 Claims, 6 Drawing Sheets

U.S. PATENT DOCUMENTS

| | | | | | |
|---|---|---|---|---|---|
| 2,544,270 | A | | 3/1951 | L'Hollier | |
| 2,596,038 | A | | 5/1952 | Mayer | |
| 2,683,316 | A | | 7/1954 | Reker et al. | |
| 2,701,925 | A | | 2/1955 | Luhr | |
| 2,740,207 | A | | 4/1956 | Starensier | |
| 2,780,013 | A | * | 2/1957 | Voss | 36/105 |
| 3,609,888 | A | | 10/1971 | Rickman | |
| 4,199,878 | A | | 4/1980 | Wossner | |
| 4,277,897 | A | | 7/1981 | O'Connell | |
| 4,495,715 | A | | 1/1985 | Fredrickson et al. | |
| 4,535,554 | A | | 8/1985 | De Obaldia | |
| 4,583,304 | A | | 4/1986 | Spalding | |
| 4,944,099 | A | * | 7/1990 | Davis | 36/97 |
| 5,035,069 | A | | 7/1991 | Minden | |
| 5,129,165 | A | | 7/1992 | Woodle | |
| 5,191,726 | A | | 3/1993 | Vallee | |
| D339,669 | S | | 9/1993 | Miller | |
| 5,247,741 | A | | 9/1993 | Pastor | |
| 5,257,969 | A | * | 11/1993 | Mance | 602/28 |
| 5,384,973 | A | | 1/1995 | Lyden | |
| 5,623,734 | A | | 4/1997 | Pugliatti | |
| 5,740,618 | A | | 4/1998 | Minden | |
| 5,806,209 | A | | 9/1998 | Crowley et al. | |
| 5,865,779 | A | | 2/1999 | Gleason | |
| 5,867,838 | A | | 2/1999 | Corry | |
| 5,956,868 | A | * | 9/1999 | Stevens et al. | 36/8.3 |
| 6,018,888 | A | * | 2/2000 | Wilkenfeld et al. | 36/8.3 |
| D437,105 | S | | 2/2001 | Mahjied | |
| 6,418,641 | B1 | | 7/2002 | Schenkel | |
| 6,588,124 | B2 | | 7/2003 | Morrone | |
| 6,745,498 | B2 | | 6/2004 | LaDuca | |
| 6,800,063 | B2 | | 10/2004 | Iwata | |
| D499,807 | S | | 12/2004 | Stauffer | |
| 6,857,203 | B2 | | 2/2005 | Minden | |
| 6,895,694 | B2 | | 5/2005 | Nye | |
| 6,915,596 | B2 | | 7/2005 | Grove et al. | |
| D515,299 | S | | 2/2006 | Burg | |
| D517,784 | S | * | 3/2006 | Wilkenfeld et al. | D2/902 |
| 7,047,669 | B2 | | 5/2006 | Polcek | |
| 7,051,457 | B1 | | 5/2006 | Huggins et al. | |
| 7,051,458 | B2 | | 5/2006 | LaDuca | |
| D530,888 | S | | 10/2006 | Kim | |
| D535,461 | S | | 1/2007 | Wilkenfeld et al. | |
| D538,515 | S | * | 3/2007 | Wilkenfeld et al. | D2/902 |
| D551,430 | S | | 9/2007 | Wilkenfeld et al. | |
| D556,436 | S | * | 12/2007 | Wilkenfeld et al. | D2/971 |
| D558,957 | S | | 1/2008 | Wilkenfeld et al. | |
| D559,504 | S | | 1/2008 | Wilkenfeld et al. | |
| 2001/0005947 | A1 | | 7/2001 | Sordi | |
| 2002/0078591 | A1 | * | 6/2002 | Morrone | 36/8.3 |
| 2002/0166257 | A1 | | 11/2002 | Wilkinson | |
| 2003/0029055 | A1 | | 2/2003 | Morrone | |
| 2003/0033729 | A1 | | 2/2003 | Farrior | |
| 2005/0132611 | A1 | | 6/2005 | Polcek | |
| 2006/0174512 | A1 | | 8/2006 | LaDuca | |
| 2006/0196078 | A1 | | 9/2006 | Terlizzi et al. | |
| 2006/0288609 | A1 | * | 12/2006 | Wilkenfeld et al. | 36/8.3 |
| 2007/0006486 | A1 | | 1/2007 | Wilkenfeld et al. | |
| 2007/0256330 | A1 | | 11/2007 | Wallin et al. | |
| 2008/0086906 | A1 | | 4/2008 | Wilkenfeld | |
| 2008/0086912 | A1 | * | 4/2008 | Wilkenfeld | 36/92 |

FOREIGN PATENT DOCUMENTS

| | | | |
|---|---|---|---|
| CH | 168702 | | 4/1933 |
| EP | 562697 | A1 | 9/1993 |
| EP | 0672362 | A1 | 9/1995 |
| WO | WO9938404 | A1 | 8/1999 |
| WO | WO9951117 | A2 | 10/1999 |

OTHER PUBLICATIONS

Save your Sole with Dance Paws (R) Barefoot Dancers—(c) Dance Paws LLC 2002, All Rights Reserved, Patent Pending, 1 page of Search Results from WayBackMachine, 2 pages printed from Nov. 28, 2002 http://webarchive.org/web/20021124044203/www.dancepaws.com/top/ home.html.

PCT International Search Report and Written Opinion dated Nov. 7, 2005 prepared by ISA/AU for PCT Appl. No. PCT/AU2005/001504; filed Sep. 29, 2005; 11 pages.

* cited by examiner

DANCE FOOTWEAR

RELATED APPLICATIONS

This application is submitted under 35 U.S.C. 371 as a U.S. National Phase application of International Patent Application Number PCT/AU2005/001504, filed Sep. 29, 2005, which claims priority to and the benefit of U.S. Provisional Application Ser. No. 60/617,612 filed Oct. 8, 2004, and U.S. Design patent application Ser. No. 29/239,169, filed Sep. 26, 2005, by David Wilkenfeld and Felicia Leoncelli, entitled DANCE FOOTWEAR, the contents of which are each hereby incorporated by reference as if recited in full herein for all purposes.

FIELD

The present invention relates to an item of footwear. In particular, the present invention relates to the field of dance shoes, such as shoes used in ballet and modern dance.

BACKGROUND

Dancing is an ancient art form found in cultures around the world. All forms of dance incorporate elements of rhythm, symmetry, repetition, exaggeration, and grace of movement. In the simplest forms of dance, these elements of rhythm, symmetry, repetition, exaggeration, and grace all are incorporated in movement of the dancer's hands and feet, with dancer's torso and limbs tending to follow movements and participate in the exercise.

As different forms and expressions of dance have evolved over the years, dancers have progressed from the ordinary, everyday sorts of movements to movements derived from actions at the edge of human endurance and athletic ability. Ballet first employed such impressive, exaggerated movements that tested the limits of the dancer's physical capabilities. Modern dance builds on the dramatic movements of classical ballet and further pushes the limits of human endurance and ability.

Ballet and modern movements can include periods of running, jumping, spinning, leaping, and physical interactions among several individuals. Virtually any ballet or modern dance exercise or performance can be physically punishing, and dancers can experience many injuries over the years. In fact, few dancers can meet the rigorous performance standards of professional dance into middle age. Dancers frequently suffer sore muscles, inflamed skin, or even cracked and bleeding feet.

The driving desire to achieve extremes in movement in ballet has spawned the development of footwear meant to facilitate graceful and inspiring movements, such as rotating on only a single toe or walking and landing on the toes, even if these movements are not natural movements for the average person. Ballet footwear enables these dance steps and can help protect the dancer's feet by distributing forces and pressures resulting from dance steps over a wide area of the outside surface of the foot and by addressing foot-to-surface or shoe-to-surface frictional requirements. The purpose of dance shoes is to achieve a balance between traction and sliding, as may be required in ballet or dance movements.

Conventional ballet slippers typically enclose the dancer's entire foot with a silky or satiny fabric having a charmeuse finish. In many forms of dance, including ballet and modern dance, a "barefoot" look is preferred, or even required. Conventional ballet slippers are designed to fit snugly against the dancer's skin, but no matter how tightly against the dancer's feet the ballet slippers fit, the slippers can still be seen. In modern dance, the desire or requirement for a truly barefoot look can be so strong that dancers wear no footwear at all, even though dancers will subject their feet to physical punishment from impacts, pulls, twists, and abrasions, or will not have the advantage of shoe-to-surface contact via a slipper or shoe that addresses the frictional requirements of the movements to be performed.

Shoes with split soles and/or uppers that expose a portion of the wearer's foot do exist. For example, Canadian patent number 1077711 and Swiss patent number 168702 describe overshoes having split soles and uppers joined together by an arrangement of straps. In embodiments having split soles and/or uppers, these shoes offer two basic types of connecting straps. The first type is a pair of connecting straps lying along the plantar surface of the shoe that joins the portions of the sole (see FIG. 4 of Canadian patent number 1077711 and FIGS. 1, 3, and 5 of Swiss patent number 168702). This pair of straps can be used alone or in combination with a second type of strap that stretches along the sides of the shoe. This second type of connecting strap can be a single, u-shaped strap that wraps from the front of the shoe around the heel (see FIG. 4 of Canadian patent number 1077711) or a pair of individual straps that connect the front and rear portions of the shoe along its sides (FIGS. 4 and 5 of Swiss patent number 168702). Importantly, these straps provide tensioning largely, or almost entirely, along the longitudinal axis of the foot or shoe (i.e., along the axis running from toes to heel, described as the Y-axis below) and they can obscure a significant portion of the side or top of the foot.

SUMMARY

The described footwear addresses frictional requirements and provides at least some protection against the physical wear and tear of dancing while leaving a middle portion of the dancer's foot bare and aesthetically visible. In particular embodiments, the footwear exposes a substantial portion of the arch of the dancer's foot, or even the entire arch of the foot. This footwear offers the advantage of helping to protect and support the wearer's feet, and address frictional requirements, while still exposing a substantial portion of the arch of the wearer's foot and middle portion of the foot, thus providing a nearly "barefoot" look.

A conventionally constructed dance shoe, either with a full sole or a split sole, has the disadvantage of masking the arch of the foot when the foot is in the tendu position. In such a conventional shoe, the fabric or material of the shoe tends to bulge outward at the center of the arch, thus defeating a desired aesthetic of the shoe: to enhance the arch of the foot and make it visible. In contrast, the present invention allows the arch of the foot to be seen and further enhances the arch, particularly when the foot is in the tendu position.

In some embodiments, the footwear of the present invention overcomes the disadvantages of conventional dance footwear by providing at least a forefoot enclosure and a rearfoot enclosure, the enclosures in combination on a wearer's foot leaving a mid-foot portion of the wearer's foot visible and exposed, the enclosures being connected and secured on the foot by a connector that is adapted to avoid or minimize visible coverage over the mid-foot so as to create an aesthetic of a bare foot, or a partially bare foot, in at least the mid-foot region of the foot and, preferably, the arch of the foot. Unlike the prior art, in certain embodiments the present invention provides a routing of a connector for forefoot and rear foot enclosures that does not follow a longitudinal path along the side or top of the foot. Instead the present invention provides a connector that has elements that follow a transverse path across the side, bottom, and/or top of the foot, which results in less visible impact to the foot aesthetic.

This and other embodiments are described in more detail in the following detailed descriptions and figures. The foregoing is not intended to be an exhaustive list of embodiments and features of the present invention. Persons skilled in the art are capable of appreciating other embodiments and features from the following detailed description in conjunction with the drawings.

DETAILED DESCRIPTION

Figure 1:
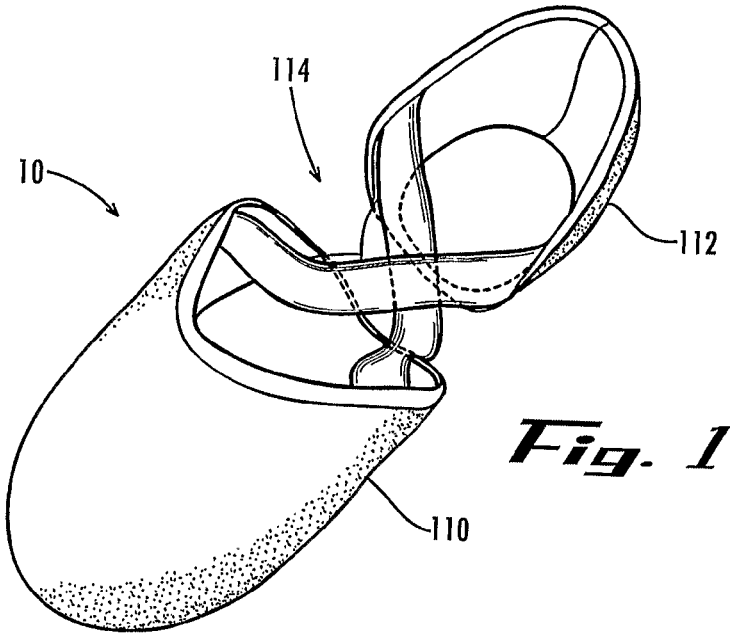
FIG. 1 shows a top (dorsal) view of one embodiment of the footwear.

Representative embodiments of the footwear are shown in FIGS. 1 through 12, wherein the same or similar features share common reference numerals.

The inventive concept behind the footwear is directed to (but not limited to) unobtrusive footwear that protects a wearer's foot, particularly the front and rear portions of the foot. Dancers are able to perform or practice their dance routines, with the arch of the foot substantially exposed, while at the same time movement is facilitated and some protection against injury is offered.

Figure 2:
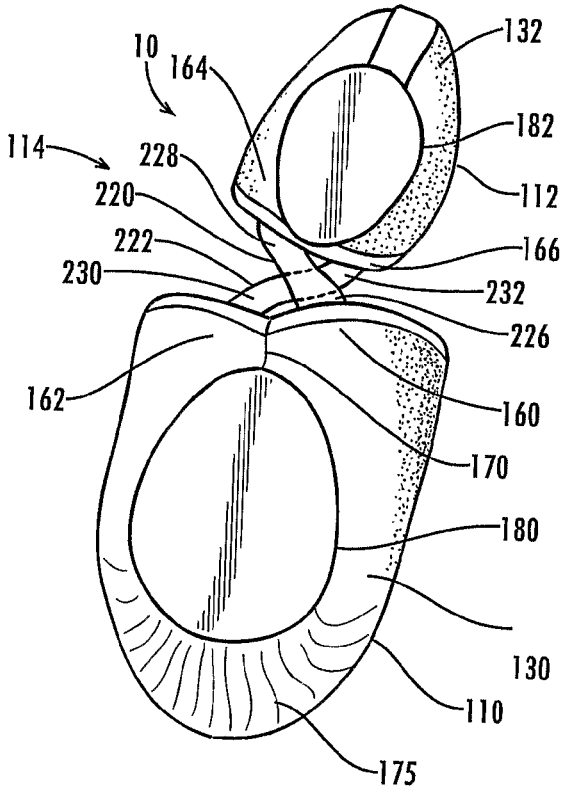
FIG. 2 shows the underside thereof, the plantar surface of the footwear.
Figure 3:
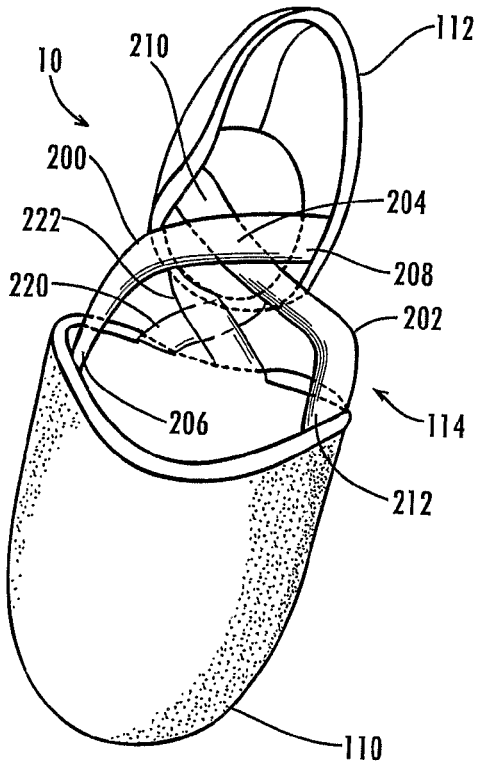
FIG. 3 shows another top view of the embodiment of footwear shown in FIGS. 1 and 2.

FIGS. 1 through 3 illustrate three different views of the footwear 10, which includes two separate foot enclosures 110, 112 and an enclosure connector 114 for connecting enclosures and securing them to a wearer's foot. First foot enclosure 110 covers a substantial portion of the front of the foot. First foot enclosure 110 covers the toes (i.e., in the region of the metatarsals and phalanges) and the ball of the foot entirely, though in some embodiments, at least a portion of the toes is exposed, such as a portion of the dorsal surface of the foot corresponding to part or all of the metatarsals. Second foot enclosure 112 covers a substantial portion of the rear of the foot including the heel.

A foot enclosure covers a portion of at least one surface of the wearer's foot, such as a portion of the dorsal, plantar, medial, or lateral surface of the foot. In some embodiments, a foot enclosure covers portions of at least two foot surfaces, such as a foot enclosure that substantially or completely surrounds a portion of the foot. For example, first foot enclosure 110 completely surrounds a portion of the wearer's forefoot and can be called a "forefoot enclosure." This forefoot enclosure covers the forefoot on all major surfaces of the foot—dorsal, plantar, medial, lateral, and in-between surfaces. The plantar portion of the forefoot enclosure can be considered a portion of the sole of the shoe, and the lateral, medial, and dorsal surfaces of the forefoot enclosure can be considered a portion of the shoe upper. Second foot enclosure substantially surrounds the rear portion of the wearer's foot and can be called a "rearfoot enclosure." The rearfoot enclosure substantially surrounds the heel and portions of the plantar, medial, and lateral surfaces of the rear of the foot. The plantar portion of the rearfoot enclosure can be considered another portion of the sole of the shoe, and the lateral, medial, and dorsal surfaces of the forefoot enclosure can be considered another portion of the shoe upper. In alternative embodiments, the footwear may include additional, separate enclosures to cover predetermined areas of the foot, which may be joined by the connector, as described below.

The foot enclosures can be made from any suitable, desired material, such as cotton, silk, and other natural fabrics; rayon, nylon, polyester, and other synthetic fabrics; leather (natural or synthetic), such as cowhide or pleather; elastic, Lycra®, Spandex®, and other elasticized fabrics and materials; rubber, such as neoprene or foam rubber; or a combination thereof. In some embodiments, an enclosure includes a lining against the wearer's foot, such as a leather enclosure with a thin cotton fabric lining. The outer surface of an enclosure can be constructed from one or a plurality of different materials.

Optionally, portions of a foot enclosure can be spaced apart from each other with a piece of elastic, neoprene, foam rubber, Lycra®, or other similar material that provides some flexibility or tensioning in the foot enclosure. This spacer can be of any suitable size or shape, such as a rectangular, triangular, circular, hexagonal, trapezoidal, or other shaped spacer. As just one example, illustrated in FIG. 9, a triangular spacer 177 can be inserted into the plantar surface of first foot enclosure 110 in the middle of the posterior portion of this foot enclosure between the plantar surfaces of lower posterior lateral portion 160 and lower posterior medial portion 162, such as at seam 170.

The connector connects the foot enclosures together and secures the footwear to the wearer's foot. Thus, a connector can be considered "means for connecting the foot enclosures" or "means for securing the footwear to a wearer's foot." The connector also leaves a portion of the wearer's foot surface exposed to external viewing, thus creating an exposed region of the foot. The connector can be designed to provide a greater exposed region of the foot, which provides more of a "barefoot look" when the footwear is worn. For example, connector 114 can be a plurality of elastic straps that lie snugly against the surfaces of the wearer's foot.

In particular embodiments (such as the illustrated embodiments), the connector is designed and configured to expose a substantial area of the mid-foot surface of the wearer's foot, such as a majority of the surface of the area surrounding the arch of the wearer's foot. The mid-foot portion includes at least one surface of the foot, some surfaces of the foot, or all surfaces of the foot, including (but not limited to) the dorsal, medial, plantar, and lateral surfaces of the foot. In preferred embodiments, the shoe exposes a mid-foot portion that includes at least one foot surface overlaying at least a portion of the metatarsal region of the foot, such as exposing a portion of the dorsal surface of the base of at least one toe on the wearer's foot.

Similar to the foot enclosures, the connector can be made from any suitable, desired material or combination of materials, including those used to construct the foot enclosures. The connector can be designed and constructed with a reduced or minimal amount of material necessary to connect the foot enclosures. For example (and as shown in the illustrated embodiments), connector 114 can be made from thin and narrow elastic straps. The connector also can be made from conventional attachment means for securing a shoe onto a wearer's foot, such as leather straps, buckles, prominent snaps, or laces that extend above the surface of the shoe. However, in preferred embodiments, the connector made from elongate elements of elasticized material, or a combination of materials, that have narrow widths and are relatively thin to minimize the visible profile of the connector on the foot areas that the elongate elements overlie. To further reduce their visible profiles, connectors can be made to match skin tones. Similarly, they can be made with a light transmissive material, or with perforations, so that the wearer's skin shows through.

The connector 114 can be made from a single piece of material or a plurality of individual pieces. If the connector is made from a plurality of individual pieces, such as a plurality of elements, the individual pieces can be of identical dimensions, substantially equal or similar dimensions, or different dimensions. For example, the connector of one illustrated embodiment (FIGS. 1-9) is composed of two pairs of elastic straps with the straps within each pair being about equal in length, while another illustrated embodiment (FIGS. 10-12) includes a pair of lower straps of about equal length, a front ankle strap, and two transverse straps of about equal length, though a lower strap, front ankle strap, and transverse strap differ in length from each other.

The enclosure connector can be a plurality of elongated pieces or elements that span the region between or among the foot enclosures and operably connect the plurality of foot enclosures to each other. In some embodiments, the connector is a collection of two or more elongate elastic elements with at least a portion of one element having a routing that follows at least a portion of the dorsal surface of the wearer's foot.

The pieces or elements of the connector can be dimensioned as desired or appropriate for certain applications. For example, the embodiment illustrated in FIGS. 1-9 has a connector made from four straps 200, 202, 220, and 222. In alternative embodiments, the straps are replaced by strands, filaments, bundles of filaments, cords (either single-piece cords or cords woven from individual filaments), netting, webbing, or other appropriate structures that provide the connecting and securing functions of the connector.

Figure 4:
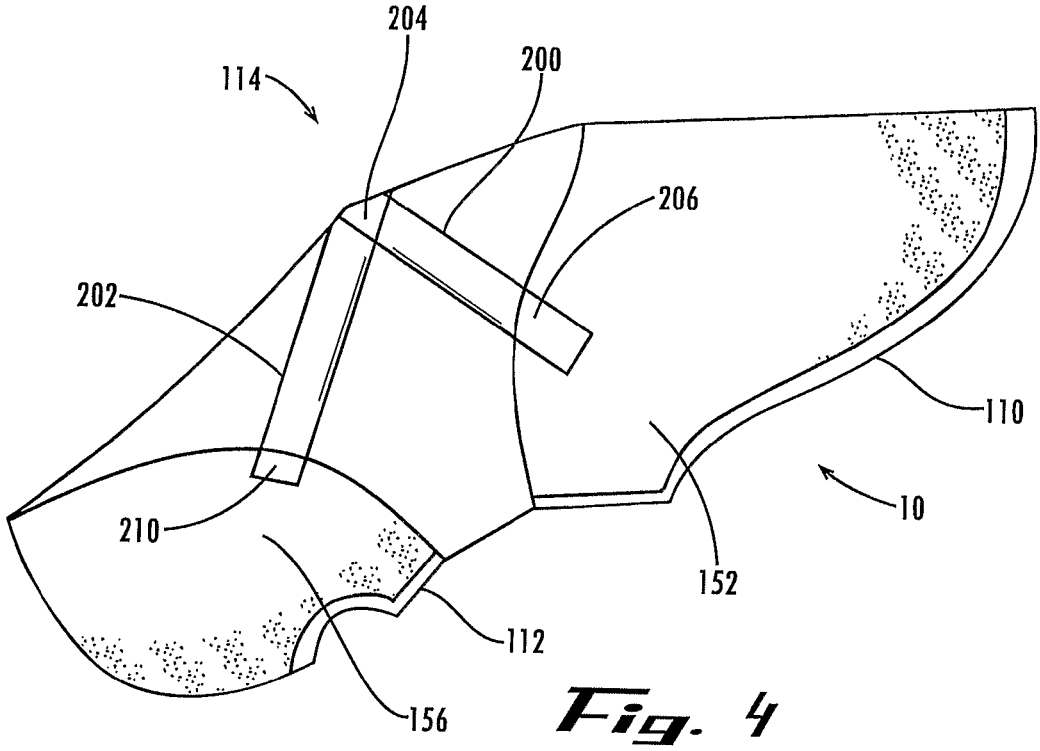
FIG. 4 is a pattern drawing for the embodiment of footwear shown in FIGS. 1-3.

FIG. 4 is a pattern drawing for one embodiment of the footwear. Dance shoe sizes are an industry standard around the world, and the pattern dimensions can be graded up or down to create other dance shoe sizes according to industry-standard grading rules. Enclosures 110, 112 and connector 114 can be dimensioned as needed or desired for a particular foot. Enclosures 110, 112 and connector 114 conform to the overall anatomy of the foot. In one embodiment, connector 114 includes four straps, a pair of upper straps 200, 202 that lie against and conform to the dorsal (top) surface of the foot; and a pair of lower straps 220, 222 that lie against and conform to the plantar surface (sole) of the foot.

The embodiment shown in FIGS. 2 and 3 has a connector 114 made from four elastic straps: first upper strap 200, second upper strap 202, first lower strap 220, and second lower strap 222. The straps of a connector can be arrayed in any suitable arrangement to form the connector, such as: separate and independent; joined together, interconnected, or otherwise attached to each other; separately arranged, non-attached, but contacting each other; or any combination thereof. As one non-limiting example, this embodiment includes two pairs of straps where the straps within each pair overlap one another. First upper strap 200 crosses over second upper strap 202 forming a first strap intersection 204. At intersection 204, a portion of second upper strap 202 is interposed between first upper strap 200 and the wearer's foot 12. Similarly, first lower strap 220 crosses over second lower strap 222 forming a second strap intersection 224. At intersection 224, a portion of second lower strap 222 is interposed between first lower strap 220 and the wearer's foot 12. At these intersections, the relevant straps slideably contact each other during movement of the dancer's foot. The lengths, attachments, and positioning of the relevant straps can be altered or adjusted to position an intersection over a different part of the wearer's foot. As just one example, the proximal ends 208, 210 of upper straps 200, 202 can be attached closer to the rear of second foot enclosure 112, which would move intersection 204 further up the wearer's foot closer to the ankle and posterior ends of the wearer's tibia and fibula.

When the footwear is worn, the upper straps 200, 202 lie against and cross over the dorsal surface of the wearer's foot, with first intersection 204 placed at or adjacent to the middle of the wearer's dorsal foot surface above the tarsals. The lower straps 220, 222 lie against and cross along the plantar surface of the wearer's foot, with the second intersection 224 placed at or adjacent to the middle of the wearer's plantar foot surface beneath the arch of the foot. The placement of upper straps 200, 202 and lower straps 220, 222 also can be seen in FIGS. 5 through 8.

In embodiment illustrated in FIGS. 1-9 (see esp. FIGS. 2-3), first end 206 of first upper strap 200 is attached to the upper posterior lateral portion 152 of first foot enclosure 110 and the second end 208 of first upper strap 200 is attached to upper anterior medial portion 154 of second foot enclosure 112. First end 210 of second upper strap 202 is attached to the upper anterior lateral portion 156 of second foot enclosure 112 and the second end 212 of second upper strap 202 is attached to the upper posterior medial portion 150 of the first foot enclosure 110. For the lower straps, first end 226 of first lower strap 220 is attached to the lower posterior lateral portion 160 of first foot enclosure 110 and second end 228 of first lower strap 220 is attached to lower anterior medial portion 164 of second foot enclosure 112. First end 230 of second lower strap 222 is attached to the lower posterior medial portion 162 of first foot enclosure 110 and second end 232 of second lower strap 222 is attached to lower anterior lateral portion 166 of second foot enclosure 112.

In the embodiment illustrated in FIGS. 1 through 3, the upper straps 200, 202 are of about equal length. First upper strap 200 has an exposed portion extending between first foot enclosure 110 and second foot enclosure 112, and this exposed portion measures about 120 millimeters in length. Second upper strap 202 also has an exposed portion extending between first foot enclosure 110 and second foot enclosure 112, and this exposed portion also measures about 120 millimeters in length. Straps of this length (about 120 millimeters) place the intersection 204 of the upper straps 200, 202 over the middle portion of a wearer's foot that is about size 4½ (for dance shoes).

Figure 5:
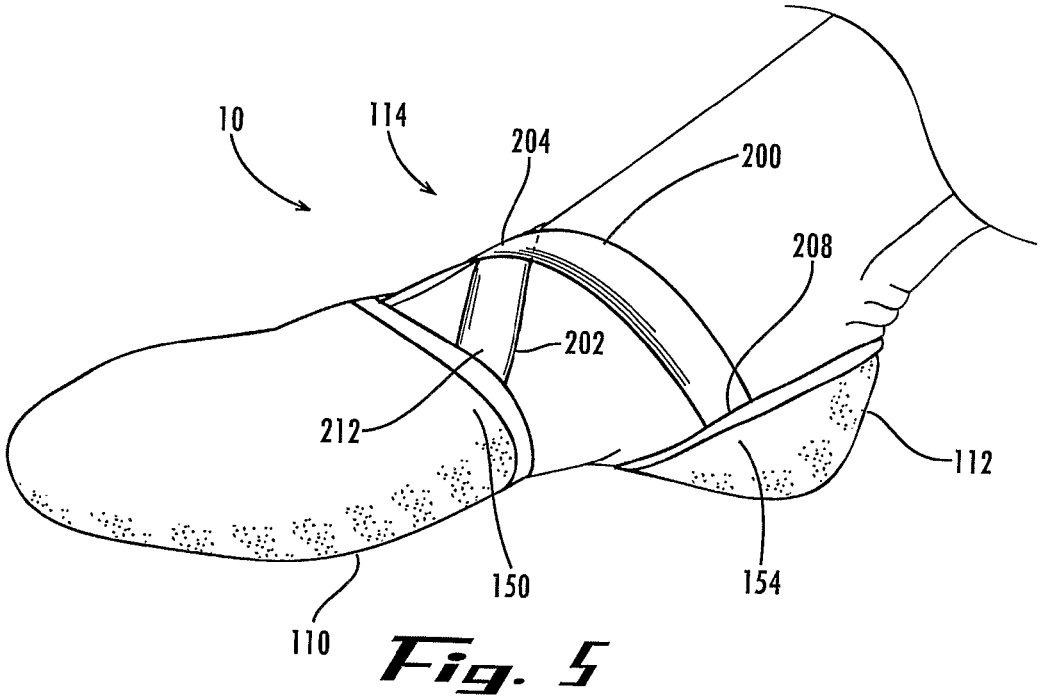
FIG. 5 shows a medial side view of the embodiment of footwear shown in FIGS. 1-3 being worn on a foot.
Figure 6:
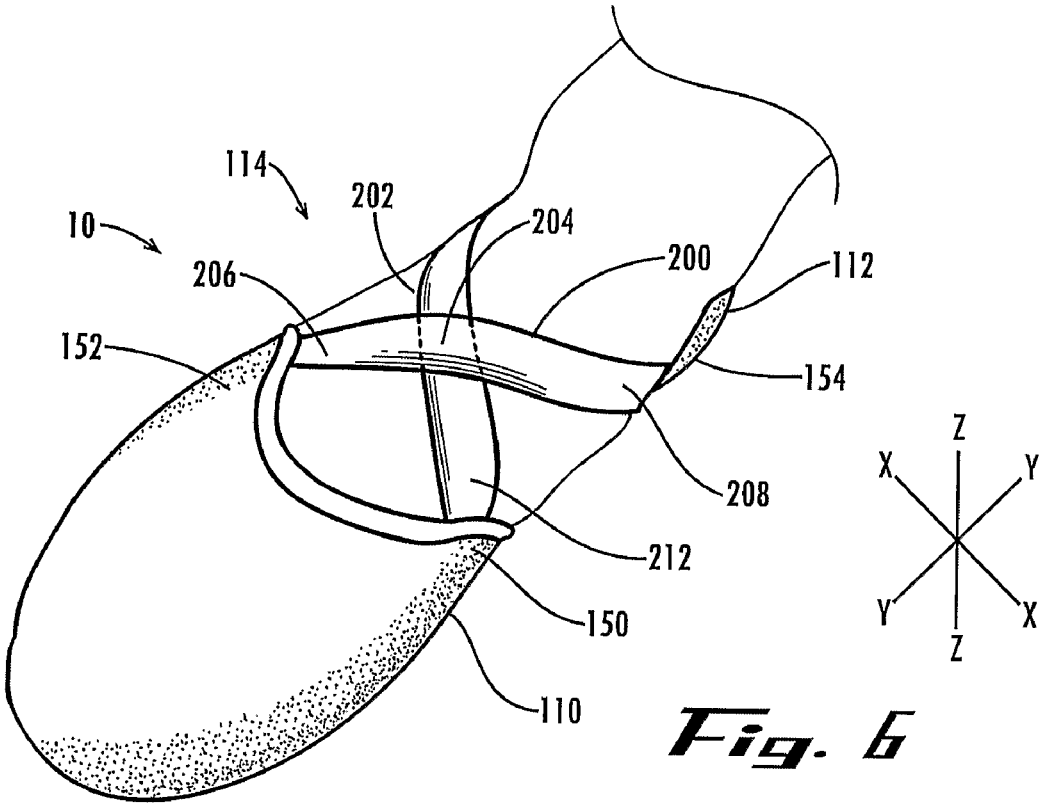
FIG. 6 shows a top (dorsal) view of the embodiment of footwear shown in FIG. 5 also being worn on a foot.
Figure 7:
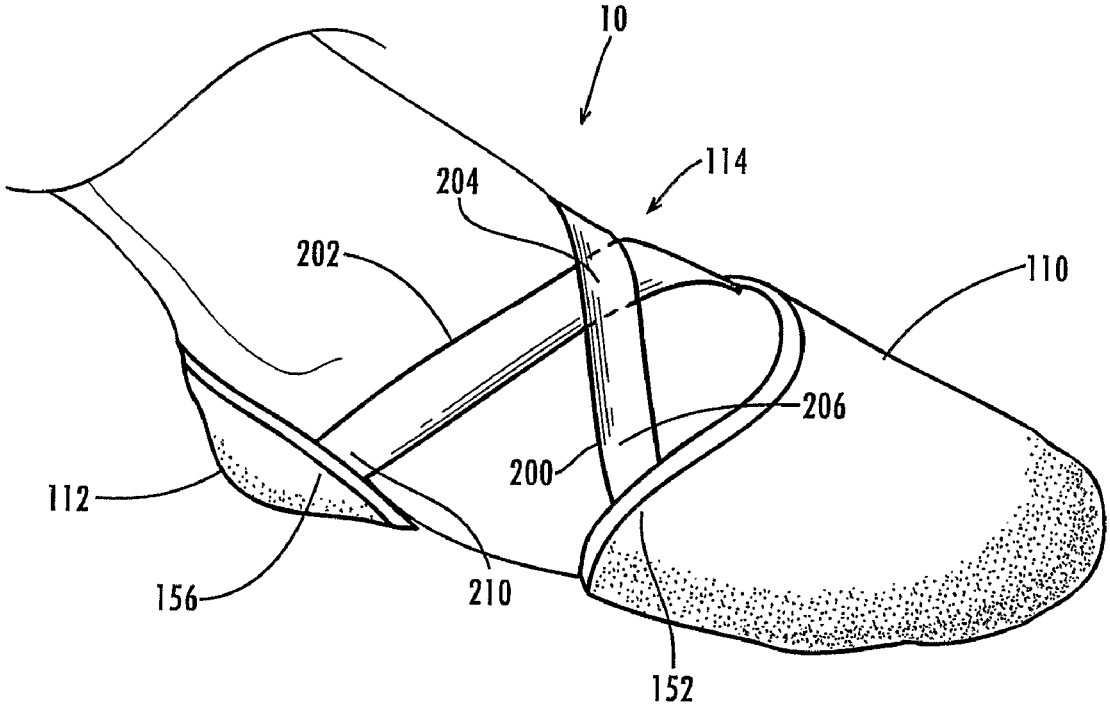
FIG. 7 shows a lateral side view of the embodiment of footwear shown in FIG. 5 also being worn on a foot.
Figure 8:
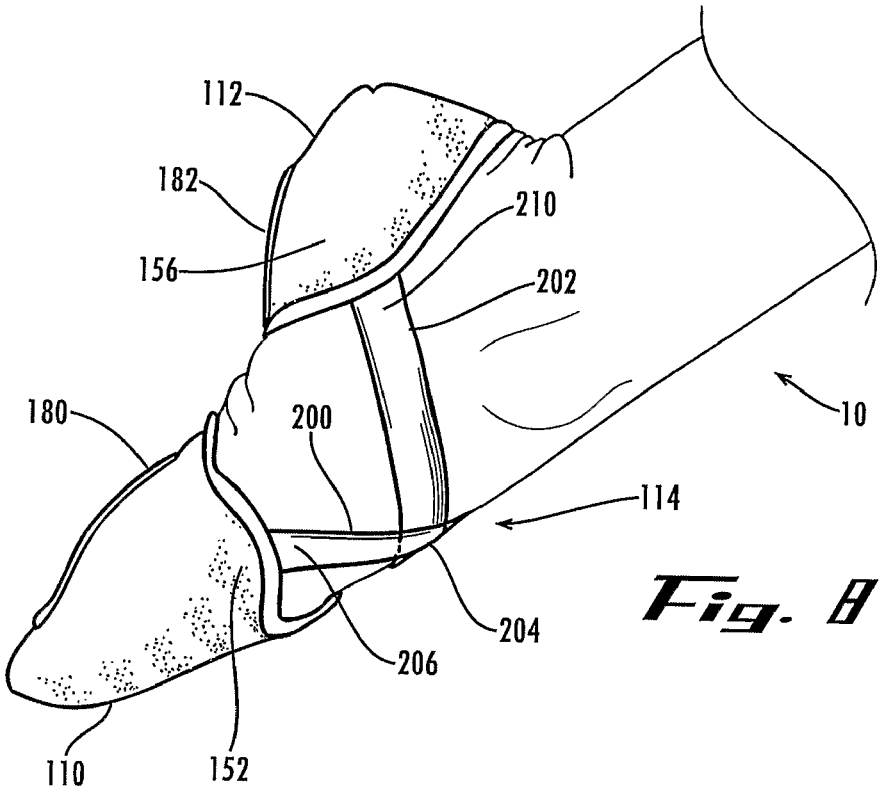
FIG. 8 shows another lateral side view of the embodiment of footwear shown in FIG. 5 also being worn on a foot.

Of course, the substantially equal lengths of these upper straps can be increased or decreased as the overall dimensions of the shoe are graded up or down to create dance shoes of other sizes or to meet the desires of a wearer. For example, a different wearer with a similar-size foot may wish to have a different configuration connector elements, such as (but not limited to): upper straps of from about 100 to about 150 millimeters in length; or upper straps of different lengths, such as a first upper strap of about 110 millimeters in length and a second upper strap of about 125 millimeters in length. Thus, the connector elements can be dimensioned according to the needs or desires of individual wearers. In fact, connector elements can be of substantially different lengths or other dimensions to alter the fitting, securement, or performance of the footwear. For example, FIGS. 5-7 show a strap 202 that lies along the talonavicular ligament of the foot, placing the intersection 204 of the upper straps 200, 202 near the proximal dorsal part of the foot. Different embodiments of the footwear with connector elements of different dimensions would position this intersection of the upper straps over a different part of the foot, such as closer to the metatarsal region along the midline of the foot, or off to one side of the foot.

Similar to the upper straps, lower straps 220, 222 can be of about equal length. Each of the lower straps 220, 222 has an exposed portion extending between first foot enclosure 110 and second foot enclosure 112 measuring about 30 millimeters in length. Straps of this length (about 30 millimeters) place the intersection 224 of the lowers straps 220,222 under the middle portion of the wearer's foot. The lengths of these lower straps can be increased or decreased as the overall dimensions of the shoe are graded up or down to create dance shoes of other sizes or to meet the desires of the wearer similar to that described above.

Figure 9:
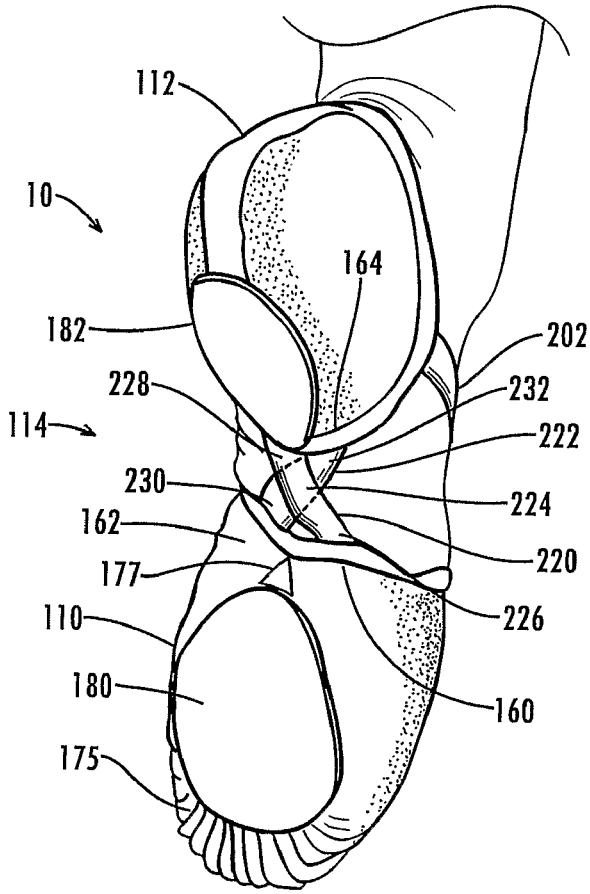
FIG. 9 shows a bottom (plantar) view of the embodiment of footwear shown in FIG. 5 also being worn on a foot.
Figure 10:
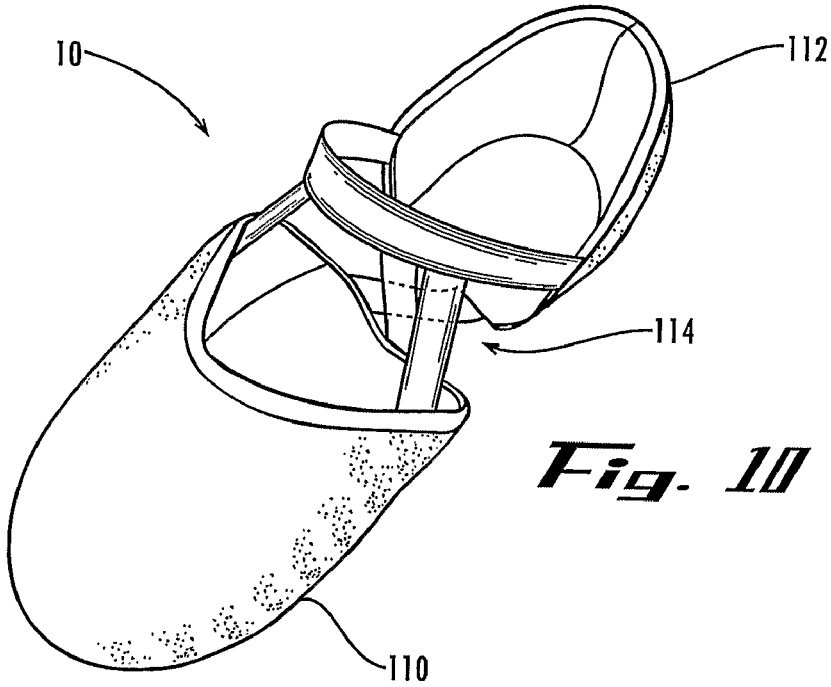
FIG. 10 shows a top (dorsal) view of an alternative embodiment of footwear.
Figure 11:
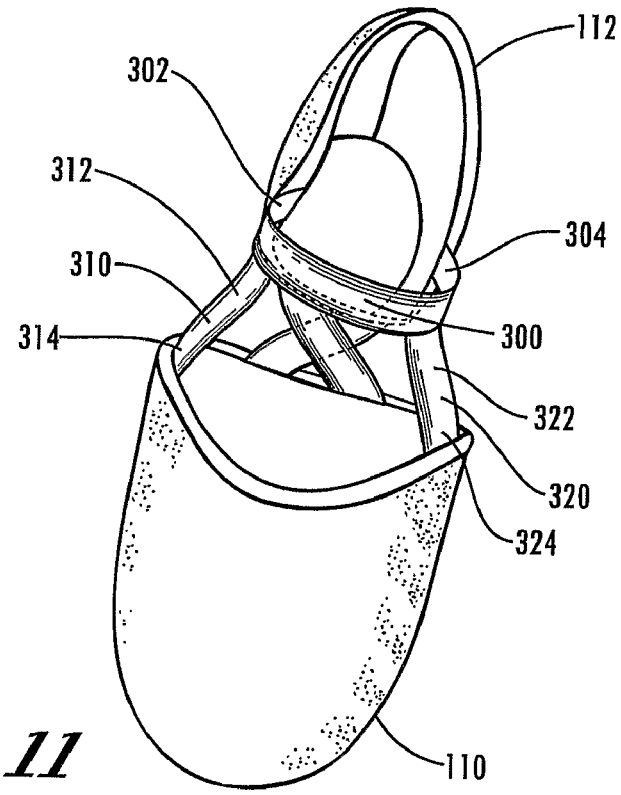
FIG. 11 shows another top (dorsal) view of the alternative embodiment of footwear shown in FIG. 10.
Figure 12:
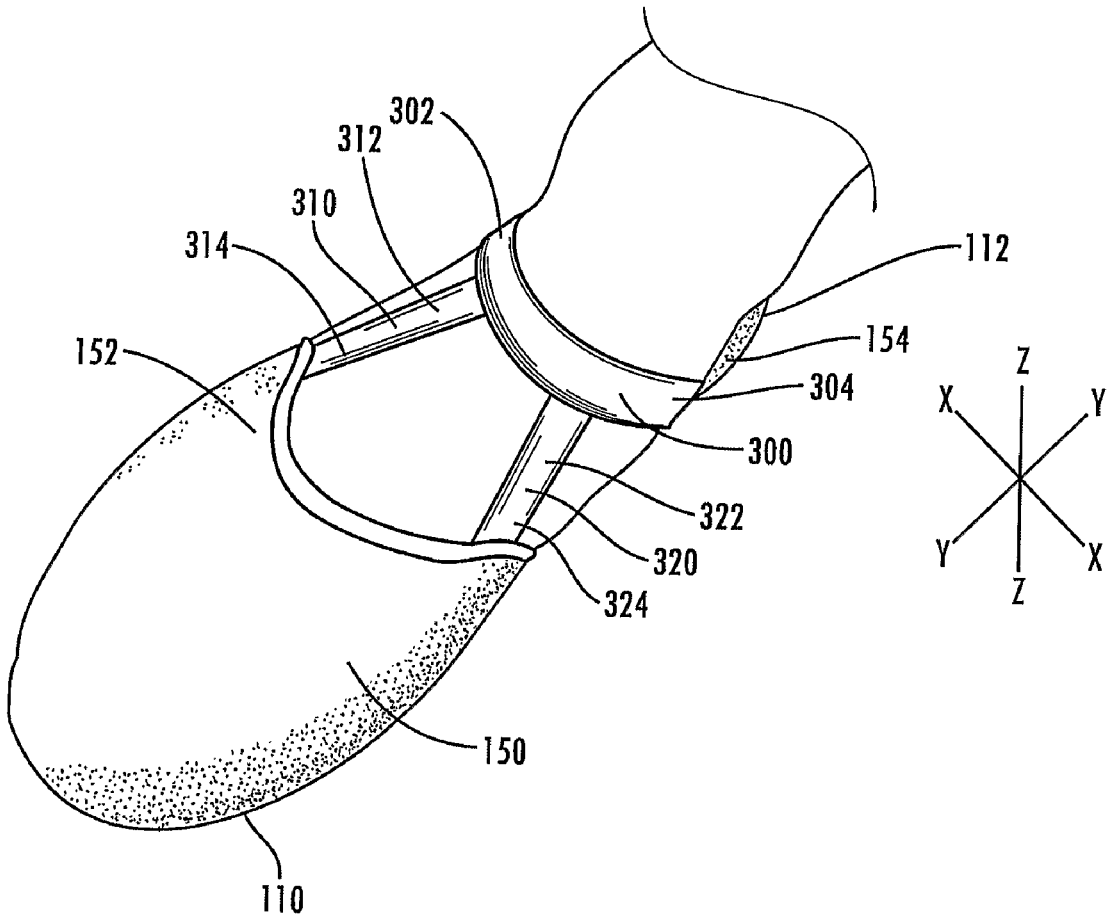
FIG. 12 shows a top (dorsal) view of the alternative embodiment of footwear shown in FIGS. 10 and 11 being worn on a foot.

FIGS. 10-12 illustrate another embodiment of the footwear having a different connector 114. Here, connector 114 includes three elongate elastic straps—a front ankle strap 300 and two transverse straps 310, 320—in place of the two upper straps of the embodiment illustrated in FIGS. 1-9. Front ankle strap 300 wraps circumferentially around the front part of the wearer's ankle (see FIG. 12), with a first end 302 attached to the upper anterior lateral portion 156 of second foot enclosure 112 and a second end 304 attached to the upper anterior medial portion 154 of second foot enclosure 112. The transverse straps 310, 320 lie alongside the wearer's foot with their longitudinal axes substantially or completely perpendicular to the longitudinal axis of front ankle strap 300. First transverse strap 310 has a first end 312 attached adjacent to the first end 302 of front ankle strap 300 and a second end 314 attached to upper posterior lateral portion 152 of first foot enclosure 110. Second transverse strap 320 has a first end 322 attached adjacent to the second end 304 of front ankle strap 300 and a second end 324 attached to upper posterior medial portion 150 of first foot enclosure 110.

The connector provides tension forces between the snug-fitting foot enclosures and secures the footwear to a dancer's foot while it is being worn. In many embodiments, the connector secures the foot enclosures to the wearer's foot using tension forces having vector components that lie in multiple dimensions, or even all three dimensions of the foot. For example, FIGS. 6 and 7 illustrate one embodiment of the footwear with each of elongate elastic upper straps 200, 202 of connector 114, and each upper strap 200, 202 providing a tension or securing force along its own longitudinal axis that is intermediate among the longitudinal, width, and height axes of the foot. Upper strap 200 provides a tension force along its longitudinal axis that pulls its ends 206, 208 toward each other, while upper strap 202 provides a tension force along its longitudinal axis that pulls its ends 210, 212 toward each other. Because the ends of the straps are attached to the enclosures, these upper straps of the connector pull forefoot enclosure 110 and rearfoot enclosure 112 toward each other and also pull the medial and lateral sides of the connectors inwardly toward the foot at the same time, thus snugly securing the entire footwear to the wearer's foot.

The front ankle strap 300 and transverse straps 310, 320 of the embodiment illustrated in FIGS. 10-12 provide similar tension forces with vector components lying in all three dimensions of the foot that also pull forefoot enclosure 110 and rearfoot enclosure 112 toward each other and also pull the medial and lateral sides of the connectors inwardly toward the foot at the same time, thus snugly securing the entire footwear to the wearer's foot.

The tension forces of a connector element can be broken down into their corresponding force vectors. FIGS. 6 and 12 include a reference key for the three common dimensions for force vectors—X, Y and Z. When a wearer is standing in place while wearing the footwear, the X- and Y-dimensions lie in the horizontal plane, and the Z-dimension lies in the vertical plane. The Y-dimension corresponds to the longitudinal axis of the foot or the shoe and runs from the toes to the heel of the foot. The X-dimension corresponds to the width axis of the foot or the shoe (perpendicular to the longitudinal axis) and runs across the foot from the lateral side to the medial side of the foot. The Z-dimension corresponds to the height axis of the foot or the shoe (perpendicular to both the longitudinal and width axes) and runs from the top to the bottom of the foot (i.e., from the dorsal surface to the plantar surface of the foot). As used above, the phrase "from . . . to . . . " used to describe the X-, Y-, and Z-dimensions is not intended to imply unidirectional axes. The Y-axis of the foot also could be considered to run from the heel of the foot to the toes; the X-dimension also could be considered to run from the medial side of the foot to the lateral side, and the X-dimension axis can be viewed as running from the bottom (plantar surface) of the foot to the top (dorsal surface).

One non-limiting feature of the connector is that at least one of its plurality of elements supplies a tension force having substantial vector components that lie in two dimensions, or all three dimensions, contributing to the snug fit enjoyed by the wearer. For example, the pi-shaped connector described herein has one element along the arch of the foot (when the shoe is worn) that induces tension along the lateral side of the foot providing security while a second element along the instep induces tension along the medial side of the foot to counteract and balance the pull direction.

In contrast, previously known connectors provided tension forces having vector components substantially only in one or two dimensions and only very minimal vector components in the other two or one dimensions. For example, if the present X,Y,Z reference key was used to analyze the tension forces in the connector of the overshoes disclosed in Canadian patent number 1077711 or Swiss patent number 168702, then the vector components of the corresponding tension forces would lie almost entirely in the Y-dimension. Those overshoes might have some de minimis vector component in the X-dimension and/or Z-dimension or even no vector component outside of the Y-dimension.

A unibody or unitary connector can be used in place of all or part of connector having multiple elements. For example, an illustrated embodiment includes a connector made from two pairs of straps (200 and 202; 220, and 222). In alternative embodiments, the two upper straps 200, 202 are replaced by a single, unibody, X-shaped strap assembly with four ends corresponding to the first ends 206, 210 and second ends 208, 212 of the two upper straps 200, 202. Additionally, the two lower straps 220, 222 can be replaced by a corresponding unibody, X-shaped strap assembly with four ends corresponding to the first ends 226, 230 and second ends 228, 232 of the lower straps 220, 222.

In the alternative to a unibody connector, a unitary connector can be constructed by attaching connector elements to each other at a fixed point of attachment. This fixed point of attachment between or among connector elements does not allow them to slideably contact each other during movement of the wearer's foot. The connector elements can be stitched together, melted together, interwoven, glued together, or otherwise attached to each other. For example, upper straps 200, 202 can be stitched or glued together at their intersection 204.

The connector can use differently shaped straps, such as a Y-shaped strap or star-shaped webbing. For example, the embodiment illustrated in FIGS. 10-12 has a "pi-shaped" strap assembly across the top of the footwear with a shape similar to the Greek letter, π. This pi-shaped assembly is considered a unitary portion of the connector because all three straps are connected, attached, or bonded to each other and do not slideably engage one another.

In some embodiments, the footwear includes a protective pad on the plantar surface of a foot enclosure. For example (and without limitation), one illustrated embodiment includes a first pad 180 on the plantar surface 130 of first foot enclosure 110, while second foot enclosure 112 includes a second pad 182 on its plantar surface 132. This protective pad may offer some measure of protection to the wearer by reducing or minimizing injuries incurred during dance exercises, such as torn or broken skin, muscle strains, accidental punctures from debris on the floor, or blisters. The pad may be made from any suitable or desired material, such as cotton padding, neoprene, foam rubber, gel, leather, plastic, woven fabric, or a combination thereof. The pad can be coupled, attached, or secured to the footwear in any suitable manner, such as, being stitched or glued to the footwear, embedded between layers of material within the footwear, or mounted on the inside of the footwear against the dancer's foot. In some embodiments, the pad is integrated within a foot enclosure, such as within an extra pocket of material or a space filled with some filler material. In alternative embodiments, the pad is a separate piece that is directly attached to or mounted on the dancer's foot before the footwear is worn.

The pad can provide a surface under the foot that is cushioned and flexible, rigid and flex-resistant, or a combination thereof. For example, the pads 180, 182 in the embodiment illustrated in FIG. 9 are made from leather and are a few millimeters thick. These pads 180, 182 offer some cushioning ability (though not as much as a pillowed cotton pad) and some rigidity (though not as much as an inflexible plastic pad) under the dancer's foot.

Additionally, a pad can be placed at any desired location on the footwear. In FIG. 9, first pad 180 is positioned to be underneath the ball of the dancer's foot and the sesamoid bones, while second pad 182 is position underneath the dancer's heel. In other embodiments, the footwear includes other pads in addition to or instead of these pads 180, 182, such as, pads on the front and/or dorsal surface of the footwear to protect the dancer's toes, on the medial and lateral surfaces of the footwear to protect the sides of the dancer's foot, or on the ventral surface of the footwear to protect the dancer's heel.

In some embodiments, the side of a pad that faces the floor has a coefficient of friction high enough to provide secure engagement between the floor and footwear, but which is still low enough to allow the dancer's foot to rotate or slide on a typically polished dance floor. In particular embodiments, the coefficient of fiction where the dancer's foot contacts the footwear is higher than the coefficient of friction where the footwear (with or without the optional pad) contacts the polished dance floor.

The footwear also can include a set of pleats on the plantar surface of the shoe, such as the pleats 175 seen in FIGS. 2 and 9. These pleats function to keep the material of the footwear snug against the wearer's foot. For example, a ballet dancer can use the footwear as a ballet shoe, and even when the wearer's foot is fully extended in the tendu position, the dorsal side of the first foot enclosure remains smooth and unruffled against the surface of the wearer's foot.

Footwear according to the present invention can be constructed or manufactured by conventional processes known by those of skill in the art. Essentially, the footwear components described herein are obtained or provided, and then the footwear is manufactured from those components. The components can be obtained or provided by directly making the components from raw materials, obtaining pre-fabricated components from other sources, acquiring rough parts from outside sources and finishing those components during the manufacturing process, or other similar methods.

As one, non-limiting example, an item of footwear can be manufactured by a series of steps in virtually any order. A forefoot enclosure and a rearfoot enclosure are obtained or provided and attached to each other with a connector. The resulting footwear includes enclosures in combination on a wearer's foot that leave a predetermined mid-foot portion of the wearer's foot visibly exposed. Additionally, the connector is adapted to avoid or minimize excess coverage over the mid-foot region so as to create a partially barefoot aesthetic, and the connector exerts a tension force having vector components substantially along both the longitudinal and width axes of the wearer's foot. In specific embodiments of this manufacturing process, the connector exerts a tension force having a substantial vector component along the height axis of the wearer's foot as well.

As another, non-limiting example, a shoe can be manufactured by obtaining or providing a forefoot enclosure, a rearfoot enclosure, and a connector, and then connecting the two enclosures to each other by means of the connector. The enclosures in combination on a wearer's foot leave a predetermined mid-foot portion of the wearer's foot visibly exposed, and the connector comprises a plurality of elongate elastic elements. A portion of at least one connector element is routed over a portion of the dorsal surface of the wearer's foot when the shoe is worn. Similar to the above example, these steps can be accomplished in any suitable order that produces the shoe.

Terms Used:

Anterior/Posterior: "Anterior" points or structures of the human body are closer to the front of the body, while "posterior" points or structures are closer to the rear. These terms roughly correspond to "ventral" and "dorsal," respectively.

Distal: farthest from the center of a person's body; when the footwear is worn on a wearer's foot, the distal direction is toward the ends of the wearer's toes.

Dorsal: Of, toward, on, in, or near the back or upper surface of an organ, body part, or organism.

Elastic: Capable of substantially resuming original shape after stretching or compression. An "elastic band," "elastic strap," or "elastic element" has this elastic property and is created from some type of elasticized material, such as (but not limited to) conventional elastic fabric made of yarns containing an elastic material, or specialized fabrics and materials such as Lycra® and Spandex®.

Medial/Lateral: "Medial" refers to points or structures near the midline of a body, while "lateral" refers to points or structures near the sides of the body. Therefore, medial structures are closer to the midsagittal plane, lateral structures are further from the midsagittal plane.

Mid-foot or "mid-foot portion": Refers to the part of the wearer's foot substantially between the phalanges and astragalus bones that encompasses at least a portion of the metatarsus region, such as the area between the forward portion of the ball of the foot nearest the toes and the ankle joint where the fibula and tibia are connected to the foot.

Plantar: Of, relating to, or occurring on the sole of the foot.

Proximal: Closest to the center of a person's body; when the footwear is worn on a wearer's foot, the proximal direction is toward the top of the wearer's ankle where the ankle joins the tibia and fibula.

Superior/Inferior: When used in an anatomical context, "superior" refers to the upper part of the human body, generally toward the head, while "inferior" refers to the lower part of the body, generally toward the feet. Superior corresponds to cranial, while inferior corresponds to caudal.

Unibody: One-piece structure. A unibody connector is cut whole from a source material, such as a unibody piece of elastic cut from a sheet of elastic.

Unitary: Relating to or characterized by or aiming toward unity. A "unitary connector" is a single element connector that is composed from individual elements attached, coupled, fastened, glued, melted, stitched, interwoven, or otherwise operably connected to one another, or other similar construction that forms a single piece from multiple pieces.

All of the anatomical terms can be used to describe the relationships of parts of the body relative to each other. For example, a person's left eye is lateral to the nose, but medial to the left ear, and a person's ankle is caudal to the fibula, but cranial to the metatarsals.

Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and claims contained therein.

We claim:

1. A shoe, comprising a forefoot enclosure and a rearfoot enclosure, the enclosures in combination on a wearer's foot leaving a mid-foot portion of the wearer's foot visibly exposed, the enclosures being connected and secured on the foot by a connector that is adapted to avoid or minimize coverage over the mid-foot region so as to create a partially barefoot aesthetic;

wherein the connector comprises a plurality of elongate elastic straps;

wherein the connector comprises a pair of upper straps that slideably contact each other at a first intersection and a pair of lower straps that slideably contact each other at a second intersection.

2. A footwear item for a wearer's foot and suitable for dance or dance exercises, comprising:

a first foot enclosure;

a second foot enclosure separate from the first foot enclosure; and a connector that operably connects the first foot enclosure to the second foot enclosure, wherein the connector comprises a plurality of elongate elastic elements configured to expose a substantial area of the mid-foot portion of the wearer's foot between the first foot enclosure and the second foot enclosure; wherein the connector comprises a first upper strap, a second upper strap, a first lower strap, and a second lower strap; and wherein each upper strap provides a tension force along a longitudinal axis of the strap and the direction of the tension force is intermediate among a longitudinal, width, and height axis of a footwear item; and wherein the straps are arranged so that the directions of the tension forces of the two upper strains intersect between a lateral side and a medial side of the footwear item at a location that corresponds to a dorsal surface of a wearer's foot.

3. The footwear item of claim 2 wherein the first and second upper straps are about of equal length.

4. The footwear item of claim 2 wherein the lower straps are about of equal length.

5. A footwear item for a wearer's foot and suitable for dance or dance exercises, comprising:

a first foot enclosure;

a second foot enclosure separate from the first foot enclosure; and a connector that operably connects the first foot enclosure to the second foot enclosure, wherein the connector comprises a plurality of elongate elastic elements configured to expose a substantial area of the mid-foot portion of the wearer's foot between the first foot enclosure and the second foot enclosure; wherein the connector comprises a first upper strap, a second upper strap, a first lower strap, and a second lower strap; and wherein the first upper strap crosses over the second upper strap forming an intersection of the upper straps.

6. The footwear item of claim 5 wherein the intersection of the upper straps is located at, or adjacent to, the proximal dorsal portion of the wearer's foot.

7. The footwear item of claim 6 wherein first lower strap crosses over the second lower strap forming an intersection of the lower straps.

8. The footwear item of claim 7 wherein the intersection of the lower straps is located at, or adjacent to, the middle of the wearer's foot.

9. The footwear item of claim 8 wherein the intersection of the upper or lower straps is located adjacent to the middle of the wearer's foot.

10. A footwear item for a wearer's foot and suitable for dance or dance exercises, comprising:

a first foot enclosure;

a second foot enclosure separate from the first foot enclosure; and a connector that operably connects the first foot enclosure to the second foot enclosure, wherein the connector comprises a plurality of elongate elastic elements configured to expose a substantial area of the mid-foot portion of the wearer's foot between the first foot enclosure and the second foot enclosure; wherein the connector comprises a first upper strap, a second upper strap, a first lower strap, and a second lower strap; and wherein:

each strap has a first end and a second end;

the first end of the first upper strap is attached to the upper posterior lateral portion of the first foot enclosure, and the second end of the first upper strap is attached to upper anterior medial portion of the second foot enclosure;

the first end of the second upper strap is attached to the upper anterior lateral portion of the second foot enclosure, and the second end of the second upper strap is attached to the upper posterior medial portion of the first foot enclosure;

the first end of the first lower strap is attached to the lower posterior lateral portion of the first foot enclosure and the second end of first lower strap is attached to the lower anterior medial portion of the second foot enclosure; and the first end of the second lower strap is attached to the lower posterior medial portion of the first foot enclosure and the second end of the second lower strap is attached to the lower anterior lateral portion of the second foot enclosure.

11. A footwear item for a wearer's foot and suitable for dance or dance exercises, comprising:

a first foot enclosure;

a second foot enclosure separate from the first foot enclosure; and a connector that operably connects the first foot enclosure to the second foot enclosure, wherein the connector comprises a plurality of elongate elastic elements configured to expose a substantial area of the mid-foot portion of the wearer's foot between the first foot enclosure and the second foot enclosure; wherein the connector comprises a first upper strap, a second upper strap, a first lower strap, and a second lower strap; and wherein the upper straps slideably contact each other forming an intersection, and this intersection is located at, or adjacent to, the proximal dorsal portion of the wearer's foot.

12. A footwear item for a wearer's foot and suitable for dance or dance exercises, comprising:

a first foot enclosure;

a second foot enclosure separate from the first foot enclosure; and a connector that operably connects the first foot enclosure to the second foot enclosure, wherein the connector comprises a plurality of elongate elastic elements configured to expose a substantial area of the mid-foot portion of the wearer's foot between the first foot enclosure and the second foot enclosure; wherein the connector comprises a first upper strap, a second upper strap, a first lower strap, and a second lower strap; and wherein the lower straps slideably contact each other forming an intersection, and this intersection is located at, or adjacent to, the midline of the plantar surface of the wearer's foot.

13. A footwear item for a wearer's foot and suitable for dance or dance exercises, comprising:

a first foot enclosure;

a second foot enclosure separate from the first foot enclosure;

a connector that operably connects the first foot enclosure to the second foot enclosure, wherein the connector comprises a plurality of elongate elastic elements configured to expose a substantial area of the mid-foot portion of the wearer's foot between the first foot enclosure and the second foot enclosure;

wherein the connector comprises a unitary elastic strap having a plurality of strap ends, and wherein the connector supplies a tension force with vector components substantially in three dimensions; and wherein the connector comprises an X-shaped elastic strap having four strap ends, wherein the first strap end is attached to the upper posterior lateral portion of the first foot enclosure;

the second strap end is attached to upper posterior medial portion of the first foot enclosure;

the third strap end is attached to the upper anterior lateral portion of the second foot enclosure; and the fourth strap end is attached to the upper anterior medial portion of the second foot enclosure.

14. The footwear item of claim 13 wherein the connector further comprises a second unitary X-shaped elastic strap having four strap ends, wherein the first strap end of the second X-shaped strap is attached to the lower posterior lateral portion of the first foot enclosure;

the second strap end of the second X-shaped strap is attached to the lower posterior medial portion of the first foot enclosure;

the third strap end of the second X-shaped strap is attached to the lower anterior lateral portion of the second foot enclosure; and the fourth strap end of the second X-shaped strap is attached to the lower anterior medial portion of the second foot enclosure.

15. A shoe, comprising a forefoot enclosure and a rearfoot enclosure, the enclosures in combination on a wearer's foot leaving a predetermined mid-foot portion of the wearer's foot visibly exposed, the enclosures being connected and secured on the foot by a connector, wherein a portion of the connector is routed over a portion of the dorsal surface of the wearer's foot when the shoe is worn;

wherein the at least one element has a first end, a second end, and a middle portion; and wherein the first end is attached at, or adjacent to, the sole of the shoe; the second end is attached at, or adjacent to, the sole of the shoe distant from the first end; and the middle portion is routed over a portion of the dorsal surface of the wearer's foot when the shoe is worn; and wherein the first end of the at least one element is attached at, or adjacent to, the medial side of the shoe; the second end is attached at, or adjacent to, the lateral side of the shoe; and the longitudinal axis of the at least one element lies intermediate between the longitudinal axis and the width axis of the shoe.

16. A shoe, comprising a forefoot enclosure and a rearfoot enclosure, the enclosures in combination on a wearer's foot leaving a predetermined mid-foot portion of the wearer's foot visibly exposed, the enclosures being connected and secured on the foot by a connector, wherein a portion of the connector is routed over a portion of the dorsal surface of the wearer's foot when the shoe is worn; and wherein the connector is a pi-shaped connector.

17. The shoe according to claim 16 wherein the connector comprises a first element along the arch of the foot when the shoe is worn providing tension force in the lateral direction.

18. The shoe according to claim 17 wherein the connector comprises a second element along the instep of the foot when the shoe is worn providing tension force in the medial direction that counteracts and balances the tension forces supplied by the first connector element.

19. The shoe according to claim 16 wherein at least one element of the connector imparts a tension force having substantial vector components in at least two of the X, Y, and Z-dimensions of a foot when the shoe is worn.

20. The shoe according to claim 19 wherein the at least one element of the connector imparts a tension force having substantial vector components in all three of the X, Y, and Z-dimensions of a foot when the shoe is worn.

21. The shoe according to claim 19 wherein two or more of the connector elements impart tension forces with each tension force having substantial vector components in at least two of the X, Y, and Z-dimensions of a foot when the shoe is worn.

22. The shoe according to claim 21 wherein each element of the connector imparts a tension force having substantial vector components in at least two of the X, Y, and Z-dimensions of a foot when the shoe is worn.

23. The shoe according to claim 22 wherein each element of the connector imparts a tension force having substantial vector components each of the X, Y, and Z-dimensions of a foot when the shoe is worn.

24. A process of manufacturing footwear, comprising:

obtaining or providing a forefoot enclosure;

obtaining or providing a rearfoot enclosure;

obtaining or providing a connector; and attaching the forefoot enclosure to the rearfoot enclosure via the connector, wherein the enclosures in combination on a wearer's foot leave a predetermined mid-foot portion of the wearer's foot visibly exposed, wherein the connector comprises a plurality of elongate elastic elements, and wherein a portion of at least one element is routed over a portion of the dorsal surface of the wearer's foot when the shoe is worn; and wherein the connector comprises a pi-shaped connector or an x-shaped connector.

25. A shoe leaving a mid-foot portion of the wearer's foot visibly exposed so as to create a partially barefoot aesthetic, comprising:

a forefoot enclosure;

a rearfoot enclosure; and a connector coupled to both the forefoot enclosure and rearfoot enclosure that connects and secures the shoe to the wearer's foot, wherein the connector is adapted to avoid or minimize coverage over the mid-foot region, and wherein the connector comprises a front ankle strap, first transverse strap, and second transverse strap.

26. The shoe according to claim 25 wherein the front ankle strap wraps circumferentially around the front part of the wearer's ankle with a first end attached to the upper anterior lateral portion of rearfoot enclosure and a second end attached to the upper anterior medial portion rearfoot enclosure.

27. The shoe according to claim 26 wherein the transverse straps lie alongside the wearer's foot with their longitudinal axes substantially or completely perpendicular to the longitudinal axis of the front ankle strap.

28. The shoe according to claim 27 wherein first transverse strap has a first end attached adjacent to the first end of front ankle strap and a second end attached to an upper posterior lateral portion of the forefoot enclosure, and wherein second transverse strap has a first end attached adjacent to the second end of the front ankle strap and a second end attached to the upper posterior medial portion of the forefoot enclosure.

29. A shoe, comprising a forefoot enclosure and a rearfoot enclosure, the enclosures in combination on a wearer's foot leaving a predetermined mid-foot portion of the wearer's foot visibly exposed, the enclosures being connected and secured on the foot by a connector that is adapted to avoid or minimize excess coverage over the mid-foot region so as to create a partially barefoot aesthetic, wherein a connector comprises an elastic portion shaped to follow a path across the bottom of the foot from a lateral side of the rear foot enclosure to a medial side of the forefoot enclosure, and another elastic portion shaped to follow a path from a medial side of the rear foot enclosure to a lateral side of the forefoot enclosure.

30. The shoe of claim 29 wherein the forefoot enclosure is adapted to expose at least a portion of the wearer's toes.

31. The shoe of claim 29 wherein the portions comprise a pair of straps having substantially different lengths.

32. The shoe of claim 29 wherein the portions comprise straps that cross at a point off the midline of the foot.

* * * * *